United States Patent [19]

Ahlers

[11] 4,381,808

[45] May 3, 1983

[54] FILLING ELEMENT FOR COUNTERPRESSURE FILLING MACHINES

[75] Inventor: Egon Ahlers, Neu-Bamberg, Fed. Rep. of Germany

[73] Assignee: Seitz-Werke GmbH, Bad Kreuznach, Fed. Rep. of Germany

[21] Appl. No.: 252,388

[22] Filed: Apr. 9, 1981

[30] Foreign Application Priority Data

Apr. 19, 1980 [DE] Fed. Rep. of Germany ..... 3015132

[51] Int. Cl.[3] ..... B67C 3/06

[52] U.S. Cl. ..... 141/39; 141/198; 141/302

[58] Field of Search ..... 141/37, 39, 40, 49, 141/52, 53, 54, 57, 58, 59, 63, 192, 197, 198, 301, 302, 303, 286, 305, 392, 4, 5, 6, 7, 8, DIG. 1; 307/308, 309; 310/11, 12; 318/445

[56] References Cited

U.S. PATENT DOCUMENTS 4,103,721 8/1978 Noguchi ..... 141/39

4,146,068 3/1979 Jordan ..... 141/39

*Primary Examiner*—Houston S. Bell, Jr.

*Attorney, Agent, or Firm*—Becker & Becker

[57] ABSTRACT

A filling element for single- and multi-chamber counterpressure filling machines. The filling element includes a filling tube which projects downwardly from a filling element body into a pressed-on bottle or container to be filled. The filling element also includes a switching member installed in the region of the filling tube for controlling the liquid flow valve, arranged inside the filling element, to close this valve when the desired filling level of liquid in the container is obtained. The filling tube is provided with a filling tube head installed from below into a suitable recess in the filling element body, and the filling tube head, with a downwardly directed shoulder, is stepped relative to the actual filling tube part. The switching member is an electrical conductor which is electrically insulated relative to the filling tube, and is placed on the outer side of the filling tube. The electrical connection device for the switching member includes an electrically insulated contact pin which is axially shiftably supported in the filling element body. The contact pin is sealed relative to the filling element body, and the end surface of the pin is pressed into electrical contact against the switching member; simultaneously, the end of the pin engages under the shoulder of the filling tube and is retractable from the region of the shoulder.

8 Claims, 5 Drawing Figures

FILLING ELEMENT FOR COUNTERPRESSURE FILLING MACHINES

The present invention relates to a filling element, for single- and multi-chamber counterpressure filling machines, and includes a filling tube which projects from a filling element body downwardly into a pressed-on bottle or container to be filled. The filling element also includes a switching member installed in the region of the filling tube for controlling the liquid flow valve, which is arranged within the filling element, to close this valve when the desired filling level of liquid in the container is obtained.

Such a filling element with a filling element body having an element housing and a frame or mounting-support for the filling tube is known from U.S. Pat. No. 3,633,635. The filling tube is sealingly installed from above into this frame or mounting, and the mounting is attached and sealed on the underside of the element housing. A switching member for controlling (closing) the liquid flow valve, which is arranged in the interior of the filling element, is in the form of a pin guided axially through the inner chamber of the entire filling element and also projecting into the interior of the filling tube itself. This construction is costly, and above all makes it difficult and time consuming to remove the filling tube from the filling element body for cleaning, servicing, or replacement. The electrical supply to the switching member must with this embodiment be effected by way of a shaft extending axially through the entire filling element.

With a filling element without a filling tube, as disclosed by German Offenlegungsschrift No. 16 07 996, an electrical switching member is installed on the pressurizing and return gas tube which extends into the container to be filled. This pressurizing and return gas tube is installed with a frame or mounting in the underside of the filling element body. With this embodiment, particular difficulty is encountered in guiding the electrical supply to the switching member through the wall of the filling element body to the frame or mounting, and through the frame to the switching member on the tensioning and return gas tube. In addition to the difficult assembly with this known apparatus, special problems in connection with the electrical insulation of the supply to the switching member are encountered. More particularly, this type of electrical supply requires special care during disassembly and reassembly of the filling element body, the frame or mounting, and the tensioning and return gas tube which is equipped with the switching member, so that the functional reliability is assured.

It is therefore an object of the present invention to significantly improve a filling element, of the previously described type, and equipped with a filling tube, in such a way that on the one hand an easy, problemless, removal of the filling tube from the filling element body is possible, yet on the other hand a secure electrical connection which is easy to disconnect and easy to reestablish is provided to the switching member arranged on the filling tube.

This object, and other objects and advantages of the present invention, will appear more clearly from the following specification in connection with the accompanying drawings, in which:

FIG. 3 shows an enlarged illustration of the region of the pressurized gas chamber housing of FIG. 1 with the contact pin inserted or pressed in;

Figure 1:
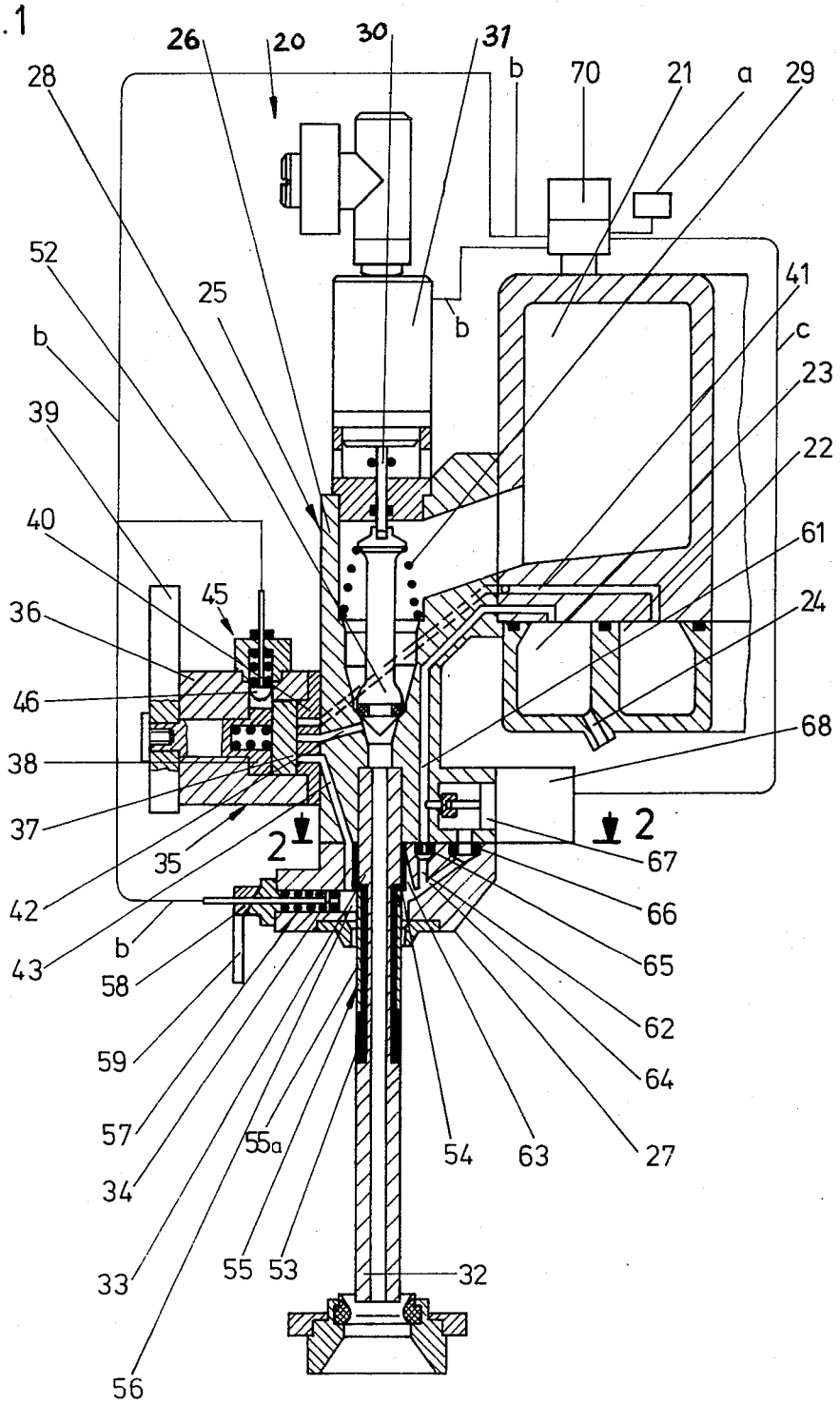
FIG. 1 is an axial section in rest position of a filling element according to the present invention for one multi-chamber embodiment.

The filling element of the present invention is characterized primarily by the following features:

(a) The filling tube is provided with a filling tube head installed from below into a suitable receiving means in the filling element body, and the filling tube head, with a downwardly directed shoulder, is stepped relative to the actual filling tube part;

(b) The switching member is an electrical conductor which is electrically insulated relative to the filling tube, and is placed on the outer side of the filling tube; and (c) The electrical connection device for the switching member includes an electrically insulated contact pin which is axially, shiftably supported in the filling element body; the contact pin is sealed off relative to the filling element body, and the end surface of the pin is pressed into electrical contact against the switching member; simultaneously, the end of the pin engages under the shoulder of the filling tube and is retractable from the region of the shoulder.

A simple technical construction is attained in this manner, which on the one hand assures a secure seating and holding of the filling tube in the filling element body, and in so doing offers an especially simple possibility for releasing and removing the filling tube from the filling element body. On the other hand, a secure electrical contact is also established which connects the switching member installed on the filling tube with its connection to the electrical switching parts of the filling element.

According to further features of the present invention, the shoulder of the filling tube, and at least that portion of the outer surface of the filling tube head adjoining the shoulder, may be provided with an electrically insulating coating or layer.

The switching member may be placed on the outer side and the shoulder of the filling tube, and the electrical contact may be established with the contact pin which is pressed against the switching member by way of the end surface and the peripheral surface at the end of the pin, whereby the electrically insulating layer extends along the outer surface of the filling tube head to the shoulder.

The contact pin may be sealed off and axially shiftably supported in a part of the filling element body, for example in a pressurized gas chamber housing, comprising electrically insulating material, preferably synthetic material.

The contact pin, except for the end face contact surface, may be provided with an electrically insulating surface layer. Alternatively, the contact pin may be provided with an electrically insulating surface layer except for the end face and the peripheral surface at the pin end.

The contact pin may be provided with a spring to press it against the switching member on the filling tube, and a lifting device which acts counter to the spring; the lifting device may be actuated from the exterior of the filling element body, and has a lift or stroke length which is greater than the width of the shoulder on the filling tube. The lifting device may comprise a rotating wedge device provided with a control or operating lever, with the contact pin being axially shiftably connected to the control lever.

Referring now to the drawings in detail, the illustrated example shows a filling element 20 for multichamber counterpressure bottle filling machines. Such filling elements of circulating filling machines, which are not illustrated in greater detail, are installed on a ring-shaped or annular liquid chamber 21, the underside of which is provided with an annular pressurized gas channel 22 and an annular venting channel 23 having continuously open outlets 24 leading into the environment. The filling element 20 has a filling element body 25 with a valve housing 26 and a pressurized gas chamber housing 27 made of electrically insulating synthetic material. A vertical liquid flow valve 28, which is under the influence of an opening spring 29, is located in the interior of the valve housing 26. An electromagnetic actuating device 31 acts by means of a plunger or push rod 30 on the valve body of the liquid flow valve 28, which body is supported upon a valve seat in the housing 26. When switched on, this actuating device 31 presses the valve body onto the valve seat against the effect of the opening spring 29, consequently establishing the closed position of the liquid flow valve 28.

A filling tube 32 having a filling tube head 33 is inserted from below at the underside of the valve housing 26. The filling tube 32 extends through the pressurized gas chamber housing 27, in which an annular pressurized gas chamber 34 is formed. A pressurized gas valve arrangement 35 is attached laterally to the valve housing 26. A valve disc 37 in the form of a control disc, and rotatable by means of a carrier or support 38, is arranged in the housing 36 of the pressurized gas valve arrangement 35. At its free end projecting from the housing 36, the support 38 has an actuating lever 39. This lever 39 cooperates during machine circulation with control elements, for example control cam or control curves, installed in different planes and at spaced intervals on the frame of the filling machine, for pivoting the valve disc 37 into the particular desired operating position. A spring presses the valve disc 37 gastight against a base plate 40, that surface thereof which faces the valve disc 37 including an opening for the pressurized gas supply conduit 41, which comes from the annular pressurized gas channel 22, and is guided through the lower leg of the annular liquid chamber 21 and through the valve housing 26. Furthermore, an equalizing conduit 42, which leads into an equalizing chamber formed between the liquid flow valve 28 and the filling tube 32, as well as the pressurized gas inlet conduit 43, which leads to the annular pressurized gas chamber 34 in the chamber housing 27 and is connected tangentially thereto, have openings discharging at that surface of the base plate 40 facing the valve disc 37.

An electrical control switch 45 is attached to the housing 36 of the pressurized gas valve arrangement 35. The feeler or sensor 46 of this control switch 45 engages the peripheral surface, of the valve disc 37 or of the valve disc support 38, which surface is embodied as a control cam. This control switch 45 serves to control the liquid flow valve 28, and the subsequently described gas outlet valve 67, as a function of the operating position of the valve disc 37.

Figure 3:
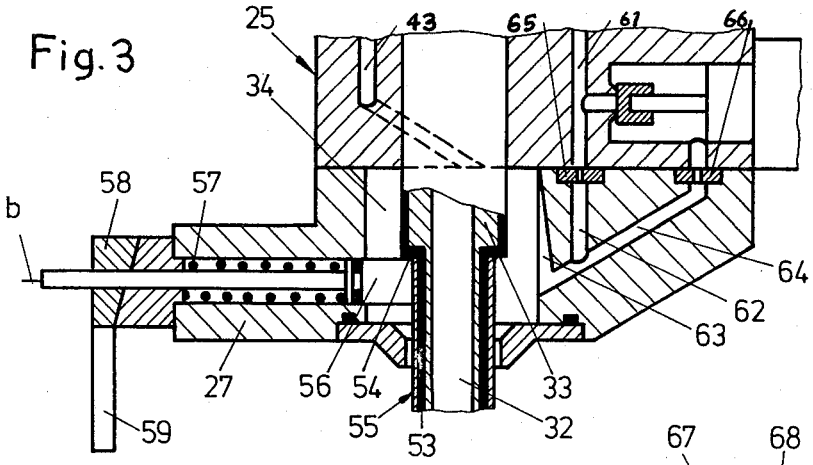
Figure 4:
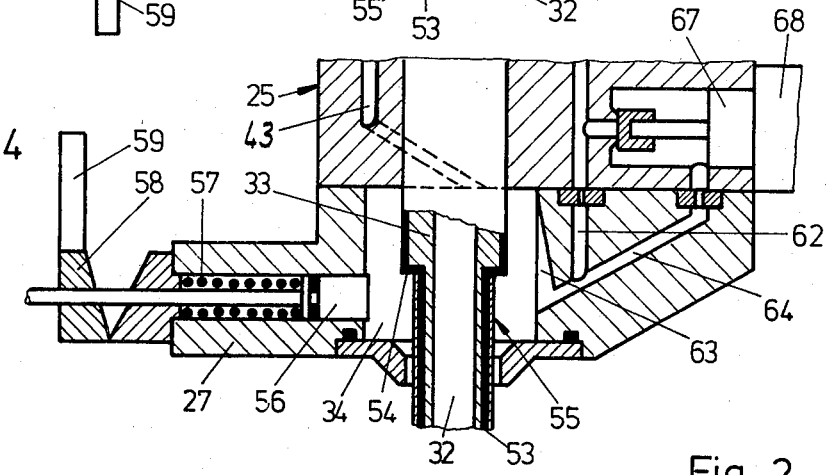
FIG. 4 shows an enlarged illustration of the region of the pressurized gas chamber housing of FIG. 1 with the contact pin retracted.

Furthermore, a switching member 55 for control of the liquid flow valve 28 is formed by having an electrically insulating layer or coating 53 applied on the outside of the filling tube 32, which is made of an electrically conductive material, especially metal. The layer 53 extends from the middle part of the actual filling-tube section upwardly to that part of the filling tube head 33 to be inserted into the valve housing 26. The electrically insulating layer 53 extends over a downwardly directed shoulder 54 formed between the actual filling tube section and the filling tube head 33, with the layer 53 likewise being applied to the shoulder 54. An annular electrical conductor **55*a* is placed on the electrically insulating layer 53, below the shoulder 54, preferably in the form of a thin, pressed-on precious metal plate, for example a gold sheet or a metal sheet provided with a gold layer or coating. The electrical conductor 55*a* extends from the shoulder 54 along the outer peripheral surface of the filling tube 32 downwardly as far as to below a level which corresponds to the desired filling level of liquid in the container (FIGS. 3 and 4**).

The electrical connection of the switching member 55, which serves as a probe, occurs by way of a contact pin 56 inserted in the electrically insulating chamber housing 27. The end face of the inner end of this contact pin 56 is pressed against the electrical conductor **55*a* by means of a spring 57, and consequently the end of the pin simultaneously engages below the electrically insulating shoulder 54, thus securing the filling tube 32 in its inserted position in the valve housing 26. A rotating wedge 58 with a pivot lever 59 is installed upon the outwardly projecting end of the contact pin 56 for the purpose of lifting the contact pin 56 off the electrical conductor 55*a* and retracting it out of the region of the shoulder (FIG. 4). The rotating wedge 58 runs on a counter rotating wedge arranged on the chamber housing 27**.

The valve housing 26 is furthermore provided with a venting conduit 61 which leads to the annular venting channel 23 located at the underside of the annular liquid chamber 21. The pressurized gas chamber 34 is connected to the venting conduit 61 by way of a discharge or outlet conduit 62 starting in the chamber housing 27 at the lower part of the annular pressurized gas chamber 34. From the opening or outflow of the outlet conduit 62, an upwardly tapered pressurized gas guidance groove 63 extends in the peripheral surface of the pressurized gas chamber 34. The outlet conduit 62 is always in open connection with the venting conduit 61 by way of a narrow nozzle 65. A branch passage or conduit 64 connected to the outlet conduit 62 below the nozzle 65 leads by way of a nozzle 66 into a valve chamber, which is in communication with the venting conduit 61; this is the valve chamber of a gas discharge or outlet valve 67 which opens and closes the connection and which is provided with an electromagnetic actuating device 68. The nozzle 66, at the entrance to the valve chamber, has a larger opening cross section than does the nozzle 65, and is installed in such a way that with the gas outlet valve 67 open, there is still maintained sufficient pressurized gas pressure in the interior of the bottle or container to be filled in order, during the filling process, to keep the liquid flow valve 28 open with sufficient certainty by means of the effect on its opening spring 29.

Of the aforementioned electrical elements, the control member 55 and the electromagnetic actuating device 31 of the liquid flow valve 28 are connected with each other via a circuit through interposition of an electrical control device 70. This electrical circuit, which is producible by liquid contact, is formed, beginning from the control member 55 and the contact pin 56 connected therewith, by a line b, which is connected to the contact pin 56 and with interposed control device 70 and connected current source a leads to the electromagnetic actuating device 31; by the liquid chamber 21; by the valve housing 26 of the filling element body 25; and by the filling tube 32. The control switch 45, with the electrical connection 52 leading away from the feeler or sensor 46, is connected in parallel in this electric circuit in the line b. By means of the valve-disc support 38, the valve disc 37, and the base plate 40, conductive connection likewise occurs with the valve housing 26 of the filling element body 25. The control device 70, which is connected to the current source a for supplying current to the circuits, has electrical switching means for controlling the actuating device 31 for the liquid flow valve 28 and, as indicated in FIG. 1, can be arranged on the upper side or in the open space of the inner periphery of the annular liquid chamber 21. The electromagnetic actuating device 68 of the gas outlet valve 67 is connected by way of the line c to further control devices installed in the control device 70.

As shown in FIG. 4, the electrical connection between the contact pin 56 and the electrical conductor 55*a* of the switching member 55 can be cancelled or disconnected by pivoting the pivot lever 59. By means of the opposite running-off of the rotating wedge 58 and the counter rotating wedge, the contact pin 56 is also retracted, against the effectiveness of the spring 57, out of the region of the shoulder 54 between the actual filling tube section and the filling tube head 33. The filling tube 32 can then be withdrawn downwardly from the seat of the filling tube head 33 in the valve housing 26 of the filling element body 25. On the other hand, the valve pin 56, under the influence or action of the spring 57, can only occupy its operating position below the shoulder 54, and establish the contact with the electrical conductor 55*a* of the switching member 55, if the filling tube 32 is installed properly and completely, with the filling tube head 33 in the appropriate receiving means in the valve housing 26.

The electrical insulation of the contact pin 56, and hence of the electrical conductor 55*a* of the switching member 55, relative to the filling tube 32 is assured thereby that the electrically insulating layer 53 is also extended over the shoulder 54 on the filling tube 32 as far as to that region of the filling tube head 33 which is to be introduced into the receiving means of the valve housing 26. The electrical insulation of the contact pin 56 relative to the valve housing 26, in the illustrated example, is assured thereby that the contact pin 56 is mounted and installed in a chamber housing 26 comprising electrically insulating material, preferably synthetic material. If the chamber housing 27 is to be made of electrically conducting material, and electrical insulation of the contact pin 56 can be attained thereby that the contact pin is provided with an electrically insulating layer which leaves free or exposed only that contact surface at the inner pin end which is to be brought into engagement with the electrical conductor 55*a*.

Figure 5:
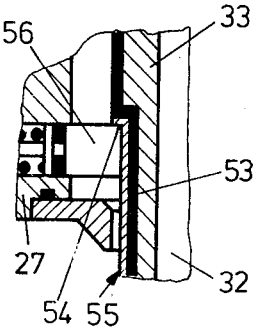
FIG. 5 is a partially sectioned view showing detail of the switching member.
Figure 2:
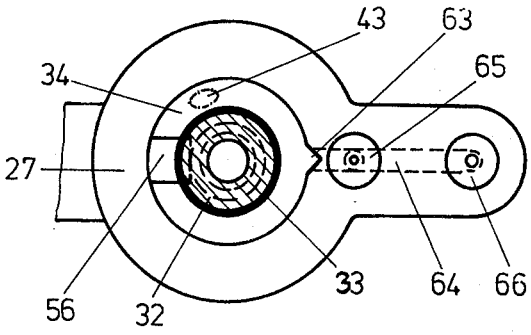
FIG. 2 is a section taken along line 2—2 of FIG. 1.

In addition to the end surface at the inner end of the contact pin 56 having contact connection with the electrical conductor 55*a* of the switching member 55, as apparent from FIG. 5 also that peripheral surface of the pin end engaging under the shoulder 54 can be used for establishing the contact without affecting the holding function of the contact pin 56 for the filling tube 32. For this embodiment of the invention, the filling tube 32 is likewise provided with the insulating layer 53, which extends from the middle part of the filling tube section upwardly beyond the shoulder 54 as far as to that part of the filling tube head 33 to be inserted or introduced in the valve housing 26. The electrical conductor 55*a* itself extends from the outer shoulder edge over the width of the shoulder 54 along the outer peripheral surface of the filling tube 32 downwardly as far as to below the level which corresponds to the filling level of liquid in the container. In this way, the end face and the peripheral surface at the inner end of the contact pin 56 are not provided with the electrically insulating layer 53, as is necessary for the pin itself if the chamber housing 27 comprises electrically conductive material. This embodiment assures electrical contact with the switching member 55 even when the end face of the contact pin 56 does not properly engage against the electrical conductor 55, for example when the lifting device 58 is not entirely reset or returned to the end position because the shoulder 54 provided with the conductor 55 is still electrically connected with the peripheral surface at the pin end.

Examples of materials which can be used for the electrically insulating material include polyamides and polytetrafluoroethylene.

The present invention is, of course, in no way restricted to the specific disclosure of the specification and drawings, but also encompasses any modifications within the scope of the appended claims.

What I claim is:

1. A filling element, for single- and multi-chamber counter-pressure filling machines, for introducing liquid into a container, said filling element comprising:

a filling element body;

a filling tube having a main portion and a filling tube head, said filling element body being provided with a suitable recess for receiving said filling tube head therein from below so that said main portion of said filling tube projects downwardly from said filling element body into a pressed-on container to be filled, said filling tube head being provided with a downwardly directed shoulder, so that said filling tube head is stepped relative to said main portion of said filling tube;

a liquid flow valve arranged in said filling element body and operatively associated with said filling tube;

a switching member installed in the region of said filling tube for closing said liquid flow valve when the desired filling level of liquid in said container is obtained, said switching member being an electrical conductor which is placed on the outer side of said filling tube and is electrically insulated relative thereto; and an electrical connection device for switching member, including an electrically insulated contact pin which is axially displaceably supported in said filling element body and is sealed off relative thereto, said contact pin having a first end and a second end, said first end of said contact pin including an end face and an adjusting peripheral surface which is perpendicular to said end face, said end face being pressable into electrical contact against said switching member, and said peripheral surface adjoining said end face being engageable under, and retractable from, the region of said shoulder of said filling tube head.

2. A filling element according to claim 1, in which said shoulder, and at least that portion of the outer surface of said filling tube head adjacent said shoulder, are provided with an electrically insulating layer.

3. A filling element according to claim 1, in which at least that portion of the outer surface of said filling tube head adjacent said shoulder is provided with an electrically insulating layer which extends to said shoulder; in which said switching member is placed on the outer side of said filling tube and on said shoulder; and in which said electrical contact between said switching member and said contact pin pressed thereagainst is established by means of said end face and said peripheral surface of said first end of said contact pin.

4. A filling element according to claim 2 or 3, in which said contact pin is axially displaceably supported in, and is sealed off relative to, a part of said filling element body comprising electrically insulating material.

5. A filling element according to claim 2, in which said contact pin, except for said end face of said first end thereof, is provided with an electrically insulating surface layer.

6. A filling element according to claim 3, in which said contact pin, except for said end face and said adjoining peripheral surface of said first end thereof, is provided with an electrically insulating surface layer.

7. A filling element according to claim 1, in which said contact pin is provided with a spring which presses said pin against said switching member, and with a lifting device which acts counter to said spring and is actuated externally of said filling element body, said lifting device having a length of effectiveness which is greater than the width of said shoulder.

8. A filling element acording to claim 7, in which said lifting device comprises a rotating-wedge device which is provided with a control lever, said contact pin being axially displaceably connected to said control lever.

* * * * *